United States Patent [19]

Mitchell

[11] Patent Number: 4,690,288

[45] Date of Patent: Sep. 1, 1987

[54] ARTICLE STORAGE AND DISPLAY DEVICE

[75] Inventor: Francoise E. L. Mitchell, South Melbourne, Australia

[73] Assignee: Tidy Chain Pty. Ltd., Prahran, Australia

[21] Appl. No.: 829,916

[22] Filed: Feb. 18, 1986

[51] Int. Cl.[4] ..... A47F 5/08

[52] U.S. Cl. ..... 211/113; 211/117; 248/327

[58] Field of Search ..... 211/89, 113, 118, 117, 211/208; 248/317, 327, 316.5, 316.7

[56] References Cited

U.S. PATENT DOCUMENTS

| | | | |
|---|---|---|---|
| 623,027 | 4/1899 | Mills | 211/117 X |
| 3,355,030 | 11/1967 | Cathcart | 211/117 X |
| 4,317,522 | 3/1982 | Garnett | 211/113 |
| 4,387,873 | 6/1983 | Paulo et al. | 211/113 X |
| 4,592,472 | 6/1986 | Carnera | 211/208 X |

*Primary Examiner*—Robert W. Gibson, Jr.

*Attorney, Agent, or Firm*—Fleit, Jacobson, Cohn & Price

[57] ABSTRACT

A storage device for the storage and/or display of articles such as toys, tools, clothing, accessories, includes at least one strand member such as a chain suspended from one end to hang vertically. The chain has a plurality of fasteners attached thereto. Each fastener includes releasable gripping jaws to which the articles are attached to be supported by the chain.

4 Claims, 4 Drawing Figures

ARTICLE STORAGE AND DISPLAY DEVICE

BACKGROUND OF THE INVENTION

This invention relates to an article storage and display device and relates particularly to a device which can be used for the storage and/or display of a wide range of articles including childrens toys, clothing, piece goods and the like.

In most households, articles, particularly childrens toys and the like, are usually stored in cupboards, wardrobes or on shelves, and such storage occupies substantial space. The stored articles, which, as well as being playthings or useful articles often have an aesthetically interesting appearance which is not utilized when the articles are stored away.

SUMMARY OF THE INVENTION

It is therefore desirable to provide a device for the storage and/or display of articles which maximizes the aesthetic appearance of articles or which can be used both to display articles or to store them in a space otherwise not used for storage purposes.

It is also desirable to provide a storage and display device which can be used in any suitable location in either domestic, commercial or industrial situations for the storage and/or display of toys, tools, clothing, footwear, accessories or any other article.

It is also desirable to provide a storage system which is relatively simple to manufacture and is easy to use.

It is also desirable to provide a display and storage system which can be utilized in shop window displays, building foyers and other similar locations.

According to one aspect of the present invention there is provided a storage device comprising a plurality of interconnected link means to form a chain having one or more strands, means for securing the chain to a support member, and one or more releasable fastener means adapted to be connected to one or more link means of the chain, said releasable fastener means being adapted to be releasably attached to an article to be carried by the chain.

In one, simple, form of the invention, a single strand chain is formed of a plurality of interconnected chain links. The releasable fastener means comprises a resilient clip member which is adapted to pass through a chain link, the clip member having a pair of jaws adapted to grip an article to be carried by the chain. A plurality of the releasable fastener means is engaged with the chain so that a plurality of articles can be supported thereby.

The chain may be supported by an appropriate hook or the like fixed to a support member. An end link of the chain can be engaged with the hook or, alternatively, an intermediate link can be engaged with the hook so as to form a support having at least two strands of chain. If desired, the chain may be connected between several means securing the chain to a support member so that the chain is suspended therebetween.

In an alternative arrangement, the storage device comprises in combination, a plurality of interconnecting link means to form a chain having one or more strands, means for suspending the chain from a support whereby the chain hangs substantially vertically, and a plurality of releasable fastener means adapted to be connected to various link means of the chain, said releasable fastener means including gripping means to which articles to be supported by the suspended chain can be attached.

In order that the invention will be more readily understood, one embodiment thereof will now be described with reference to the accompanying drawings wherein:

DESCRIPTION OF PREFERRED EMBODIMENT

Figure 1:
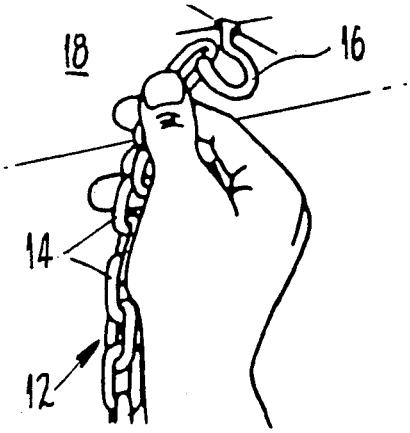
FIG. 1 shows the storage device of the invention being attached to the support.
Figure 2:
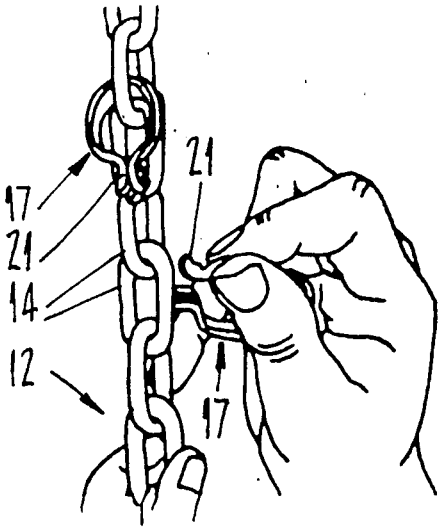
FIG. 2 illustrates one of the releasable fasteners being attached to the chain.
Figure 3:
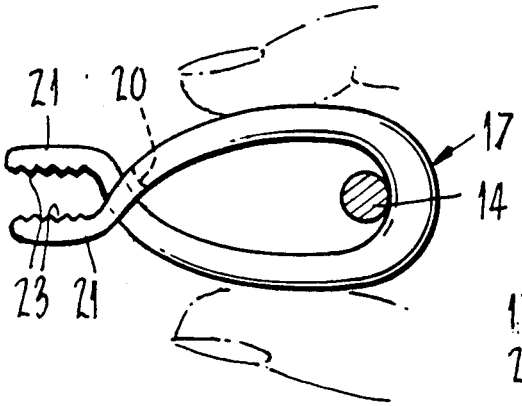
FIG. 3 shows a releasable fastener used with this embodiment of the invention.

Referring to the drawings, the storage device of this embodiment comprises a chain 12 formed of a plurality of interconnected links 14, a hook support for the chain 16 and a plurality of releasable fasteners 17.

The hook 16, which may be a standard cup-hook, or the like, is fastened to a support member 18, which may be a ceiling batten or the like. When the hook 16 is located on the support 18, the chain 12 is connected thereto by one of the chain links 14. In the form of the invention illustrated, an end link 14 is engaged with the hook 16 so that a single chain strand is supported by the hook 16. However, it will be appreciated that any other link 14 may be connected to the hook 16 to form a plurality of chain strands.

Figure 4:
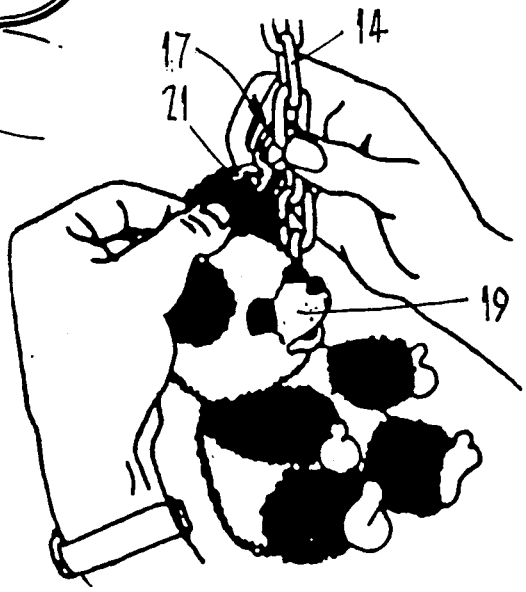
FIG 4 illustrates the manner by which an article is secured to the chain by the releasable fastener.

A number of releasable fasteners 17 are mounted on various links 14 of the chain 12 to enable articles to be connected to the chain and supported thereby. Such articles may comprise soft toys, 19, as illustrated in FIG. 4, or any other article such as clothing, tools, piece goods and the like.

The releasable fasteners 17 are preferably constructed so as to be engageable with a link 14 by flexing the fastener 17 to open opposed jaws 21. When the fastener 17 is engaged with a link 14, the resilience of the fastener closes the jaws sufficiently that the fastener will not disengage from the link.

The opposed jaws 21 of the fastener 17 are formed with one jaw having a slot 20 therein such that the opposed jaw can pass through the slot 20 on compression of the fastener body. The jaws 21 are formed with gripping means 23, and an article to be supported is placed between the jaws 21 when in the compressed position so that, on release of the compressive force, the resilience of the fastener material causes the jaws 21 to move towards each other to grip the article 19 therebetween.

Preferably, the releasable fasteners 17 are formed of a synthetic plastic material. It is also preferred that the chain links 14 are formed of a synthetic plastic material although other materials, such as metal may be used if desired.

The number of articles to be supported by the device is limited only by the number of releasable fasteners 17 connected to the chain links 14. The device may be mounted in a child's bedroom or playroom to enable soft toys, clothing and other articles to be hung from the chain 12 thus providing effective storage therefore and also providing a visually pleasing effect.

The storage device of the invention can be installed within cupboards, in shop windows and the like and used both for functional storage purposes as well as for hanging articles for aesthetic appearance.

The interconnected chain links comprise a simple form of the invention, but it will be appreciated that other link forms or flexible strands with integral loops or other engagement means may be used in providing a storage device in accordance with the present invention.

I claim:

1. A storage or display device for maintaining a plurality of articles in a desired relationship comprising, in combination, a plurality of links of synthetic plastic material interconnected to form a chain having one or more strands, suspending means for suspending the chain from a support so that the chain hangs freely, substantially vertically, and a plurality of fastener means to be connected through a plurality of spaced links of the chain to be carried thereby, said fastener means having releasable gripping means to grip articles for support by the suspended chain.

2. A device according to claim 1, wherein said fastener means comprises a clip formed of resilient plastic material and having opposed arms each terminating in jaw means, one of the jaw means being slotted such that the other jaw means is able to pass therethrough to a position where the jaw means are spaced apart to receive therebetween an article to be supported thereby.

3. A device according to claim 1, wherein said releasable gripping means comprises a pair of jaw members biased towards each other.

4. A storage device comprising a plurality of interconnecting links forming a chain having at least one strand, suspending means for suspending one end of the chain from a support so that the chain hangs substantially vertically, and a plurality of releasable fastener means connected through spaced links of the chain, said releasable fastener means including a clip having opposed arms biased towards each other when an article is gripped therebetween and to grip articles so that the articles are supported by the suspended chain, each arm terminating in jaw means, one of the opposed arms having a slot such that the other opposed arm is able to pass through said slot to a position where the jaw means are spaced apart to receive therebetween an article to be supported thereby.

* * * * *